US007650695B1

(12) United States Patent
Ju

(10) Patent No.: US 7,650,695 B1
(45) Date of Patent: Jan. 26, 2010

(54) METHOD OF ASSEMBLING CONDUCTIVE TERMINALS OF A PLURALITY OF ELECTRICAL CONNECTORS AND ELECTRICAL CONNECTOR MODULE ASSEMBLED THEREBY

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/232,026

(22) Filed: Sep. 10, 2008

(51) Int. Cl.
*H01R 43/00* (2006.01)

(52) U.S. Cl. ..... 29/884; 439/540.1

(58) Field of Classification Search ..... 29/884, 29/883, 874; 439/540.1
See application file for complete search history.

(56) References Cited

U.S. PATENT DOCUMENTS 7,207,836 B2 * 4/2007 Tsai ..... 439/541.5

* cited by examiner

*Primary Examiner*—Ross N Gushi
(74) *Attorney, Agent, or Firm*—Rosenberg, Klein & Lee

(57) ABSTRACT

A method of assembling conductive terminals of a plurality of electrical connectors includes the steps of: (1) providing at least two overlapping housings each of which has a terminal receiving portion including fixing holes and guiding holes each partially overlapping one fixing hole; (2) providing a terminal carrier structure with a carrier, wherein at least two conductive terminal groups are alternately disposed on the carrier and each group has at least two conductive terminals with free ends; (3) disposing the carrier structure behind the housings; (4) pushing the carrier structure so that the free ends are inserted into the fixing holes; and (5) removing the carrier so that each conductive terminal is separated from the carrier and each housing and the engaging conductive terminal group form one electrical connector. Accordingly, the present invention can reduce assembly procedure, improve production efficiency and reduce manufacturing cost.

13 Claims, 16 Drawing Sheets

METHOD OF ASSEMBLING CONDUCTIVE TERMINALS OF A PLURALITY OF ELECTRICAL CONNECTORS AND ELECTRICAL CONNECTOR MODULE ASSEMBLED THEREBY

BACKGROUND OF THE INVENTION

1. Field of the Invention

The present invention relates to a method of assembling conductive terminals of a plurality of electrical connectors and electrical connector module assembled thereby.

2. Description of Related Art

With the development of various electronic products and personal computers and the expansion of peripheral equipment for various electronic products, electronic products have more and more connectors. USB (Universal Serial Bus) is an electronic connector for high speed signal transmission. Since USB has the advantages of hot-swap, convenient carry, unified standard and connecting with different kinds of equipment, USB is widely used for connecting various electronic products with peripheral equipment.

At present, an electronic product generally has a plurality of independent USB connectors or a connector module formed by a plurality of USB connectors together disposed therein. As shown in FIG. 19 and FIG. 20, a common connector module 9 includes at least four overlapping USB connectors 91, 92, 93 and 94, and each USB connector 91, 92, 93 or 94 includes an inserting surface 910, 920, 930 or 940 which has a row of parallel terminal holes 911, 921, 931 or 941 formed therein. That is, the connector module 9 has four rows of terminal holes 911, 921, 931, 941 overlapping from up to down, and there is no misalignment or little misalignment in each row of terminal holes 911, 921, 931 and 941 in the vertical direction. So it correspondingly needs four conductive terminal groups 912, 922, 932 and 942 which have a similar structure and are arranged from up to down, and there is no misalignment or little misalignment between corresponding conductive terminals of the conductive terminal groups 912, 922, 932 and 942, which are arranged from up to down.

Generally speaking, only one conductive terminal is connected with the same terminal carrier structure 901, 902, 903 or 904 and located in the same vertical direction with the terminal carrier structure 901, 902, 903 or 904, so the conductive terminals of each group with no misalignment or little misalignment in the vertical direction need to be respectively formed on four different terminal carrier structures 901, 902, 903 and 904, which causes that the production procedure of the terminals becomes complex. Furthermore, because different conductive terminal groups 912, 922, 932 and 942 have different bent height, so the conductive terminals of different groups have different length. Accordingly, the conductive terminals of each group are formed by stamping metal sheets with different width. After the terminal carrier structures 901, 902, 903 and 904 are formed, the metal between the conductive terminals is removed as waste material. Since the center distance (2.0 mm-2.5 mm) between two adjacent conductive terminals of each conductive terminal group is far greater than the width (about 1.0 mm) of each conductive terminal (please refer to FIG. 16 simultaneously), more waste material (the width of about 1.0 mm-1.5 mm) is produced between each two adjacent conductive terminals, which reduces the utilization rate of the terminal carrier structures 901, 902, 903 and 904, brings a great waste of material and increases manufacturing cost.

Additionally, during assembly, one terminal carrier structure 901, 902, 903 or 904 generally corresponds to one assembling step, so two terminal carrier structures need to be assembled in two assembling steps, that is, the conductive terminals of the four conductive terminal groups need to be mounted on an insulating body in four times and then respectively riveted and fixed, thereby the manufacturing and assembling steps are increased, which reduces the assembly efficiency of the conductive terminals and the insulating body and restricts manufacturing cost.

Hence, there is a need for a new method of assembling conductive terminals of a plurality of electrical connectors and electrical connector module assembled thereby to overcome the shortcomings described above.

SUMMARY OF THE INVENTION

An object of the present invention is to provide a method of assembling conductive terminals of a plurality of electrical connectors which is convenient for assembly of conductive terminals and has low manufacturing cost and high production efficiency.

To achieve the above-mentioned object, a method of assembling conductive terminals of a plurality of electrical connectors in accordance with the present invention is provided. The method includes the steps of: (1) providing at least two housings which are overlapping up and down, wherein each housing has a terminal receiving portion opened sideward and the terminal receiving portion includes at least two fixing holes extending forward from a rear end of the housing and at least two guiding holes formed in the rear end of the housing, each guiding hole partially overlapping one of the fixing holes; (2) providing a terminal carrier structure with a carrier, wherein at least two conductive terminal groups are alternately disposed on the carrier and each conductive terminal group has at least two conductive terminals each of which has a free end extending from, and there is height difference between the position of each free end of one of the conductive terminal groups and the position of each free end of the other conductive terminal group, and each free end of each conductive terminal group corresponds to one of the guiding holes of one of the terminal receiving portions; (3) disposing the terminal carrier structure behind the overlapping at least two housings so that the free end of each conductive terminal is located behind one of the guiding holes, respectively; (4) pushing the terminal carrier structure so that the free end of each conductive terminal is inserted into the corresponding fixing hole along the corresponding guiding hole; and (5) removing the carrier so that each conductive terminal is separated from the carrier and each housing and the conductive terminal group engaged in the housing form one electrical connector.

In the method of assembling conductive terminals of a plurality of electrical connectors of the present invention, the terminal carrier structure has the carrier and at least two conductive terminal groups are alternately disposed on the carrier, so the material utilization rate of the terminal carrier is improved greatly, unnecessary waste is reduced and the manufacturing cost is reduced. Each guiding hole is partially overlapping one of the fixing holes and the free end of each conductive terminal is inserted into the corresponding fixing hole along the corresponding guiding hole; that is, the guiding holes have the function of guiding the conductive terminals, so that the conductive terminals can be correctly correspondingly inserted in the corresponding fixing holes during assembly, even if the free ends of the conductive terminals cannot completely correspond to the corresponding fixing holes originally. Furthermore, the terminal carrier structure has the carrier and at least two conductive terminal groups are alternately disposed on the carrier, wherein each conductive terminal group has at least two conductive terminals each of which has a free end extending from, and there is height difference between the position of each free end of one of the conductive terminal groups and the position of each free end of the other conductive terminal group, and each free end of each conductive terminal group corresponds to one of the guiding holes of one of the terminal receiving portions, respectively. Then the terminal carrier structure is disposed behind the overlapping at least two housings so that the free end of each conductive terminal is located behind one of the guiding holes, respectively. Push the terminal carrier structure so that the free end of each conductive terminal is inserted into the corresponding fixing hole along the corresponding guiding hole; and remove the carrier so that each conductive terminal is separated from the carrier and each housing and the conductive terminal group engaged in the housing form one electrical connector. Accordingly, the assembly procedure is reduced, the production efficiency is improved and the manufacturing cost is reduced.

Another object of the present invention is to provide an electrical connector module which is assembled by method of assembling conductive terminals of a plurality of electrical connectors. The electrical connector module is convenient for assembly and has low manufacturing cost and high production efficiency.

To achieve the above-mentioned object, an electrical connector module in accordance with the present invention is provided. The electrical connector module includes at least two electrical connectors overlapping up and down. Each electrical connector includes a housing having a terminal receiving portion in one of its sides, wherein the terminal receiving portion includes at least two fixing holes and at least two guiding holes which are formed in the side end of the housing, each guiding hole is selected to partially overlap at least one of the fixing holes at least and has at least one guiding surface connected with one of the fixing holes; and at least one conductive terminal group respectively corresponding to the terminal receiving portion and each has at least two conductive terminals, wherein each conductive terminal has a fixing portion fixed in one of the fixing holes, and a carrier disconnected portion extends from the fixing portion and is extended out of the housing from the fixing hole through the guiding hole; wherein the carrier disconnected portions of the electrical connectors are cut from the same carrier.

In the electrical connector module of the present invention, since each guiding hole has at least one guiding surface connected with one of the fixing holes; that is, each guiding surface has the function of guiding the corresponding conductive terminal, the conductive terminal can be correctly correspondingly inserted in the corresponding fixing hole during assembly, even if the conductive terminal cannot completely correspond to the corresponding fixing hole originally, thereby improving assembly quality and production efficiency effectively. At least two electrical connectors are overlapping up and down and the carrier disconnected portions of the two electrical connectors are cut from the same carrier, so the material utilization rate of the terminal carrier structure is improved greatly, unnecessary waste is reduced and the manufacturing cost is reduced. Furthermore, the carrier disconnected portions of at least two of the electrical connectors are cut from the same carrier, that is, during assembly, at least two conductive terminal groups connected with the same carrier are respectively inserted in at least two terminal receiving portions of the housings, and after the two conductive terminal groups are cut from the same carrier, each housing and the conductive terminal group correspondingly received in the housing can form one electrical connector. Accordingly, the assembly procedure is reduced, the production efficiency is improved and the manufacturing cost is reduced.

DETAILED DESCRIPTION OF PREFERRED EMBODIMENTS

The following is the detailed description of the method of assembling conductive terminals of a plurality of electrical connectors and electrical connector module assembled thereby of the present invention according to the figures.

Figure 1:
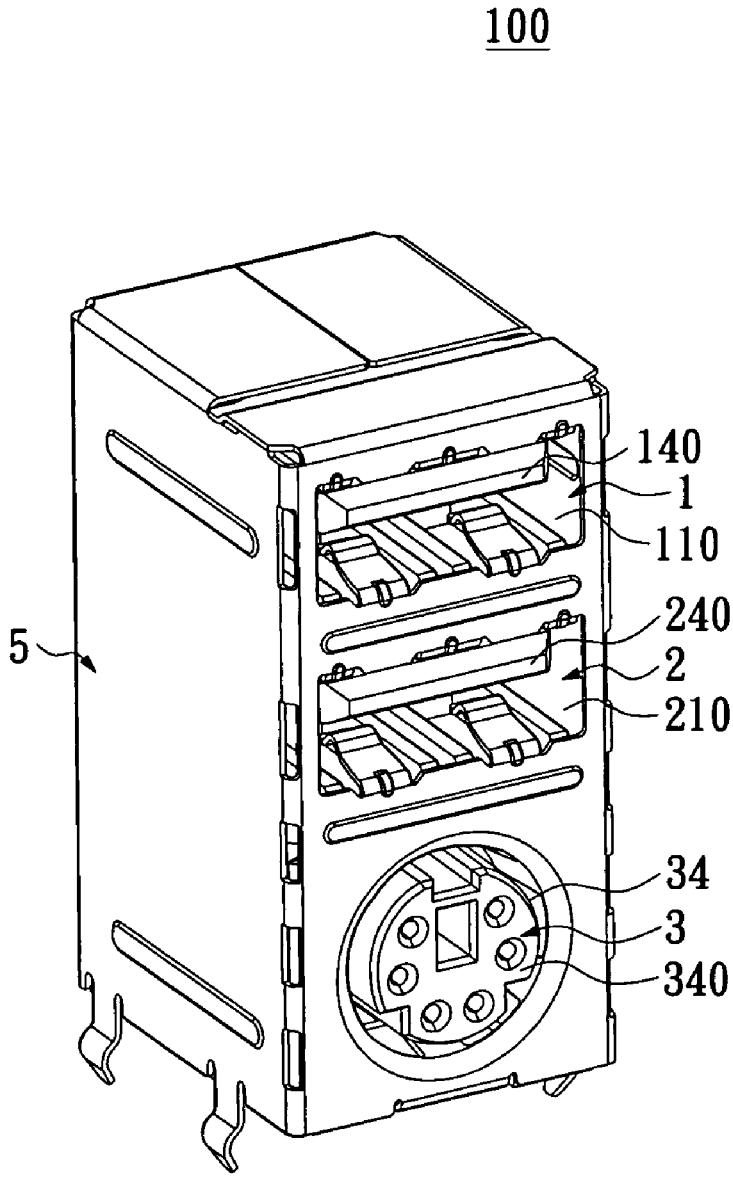
FIG. 1 is an assembled perspective view of an electrical connector module according to the present invention.
Figure 2:
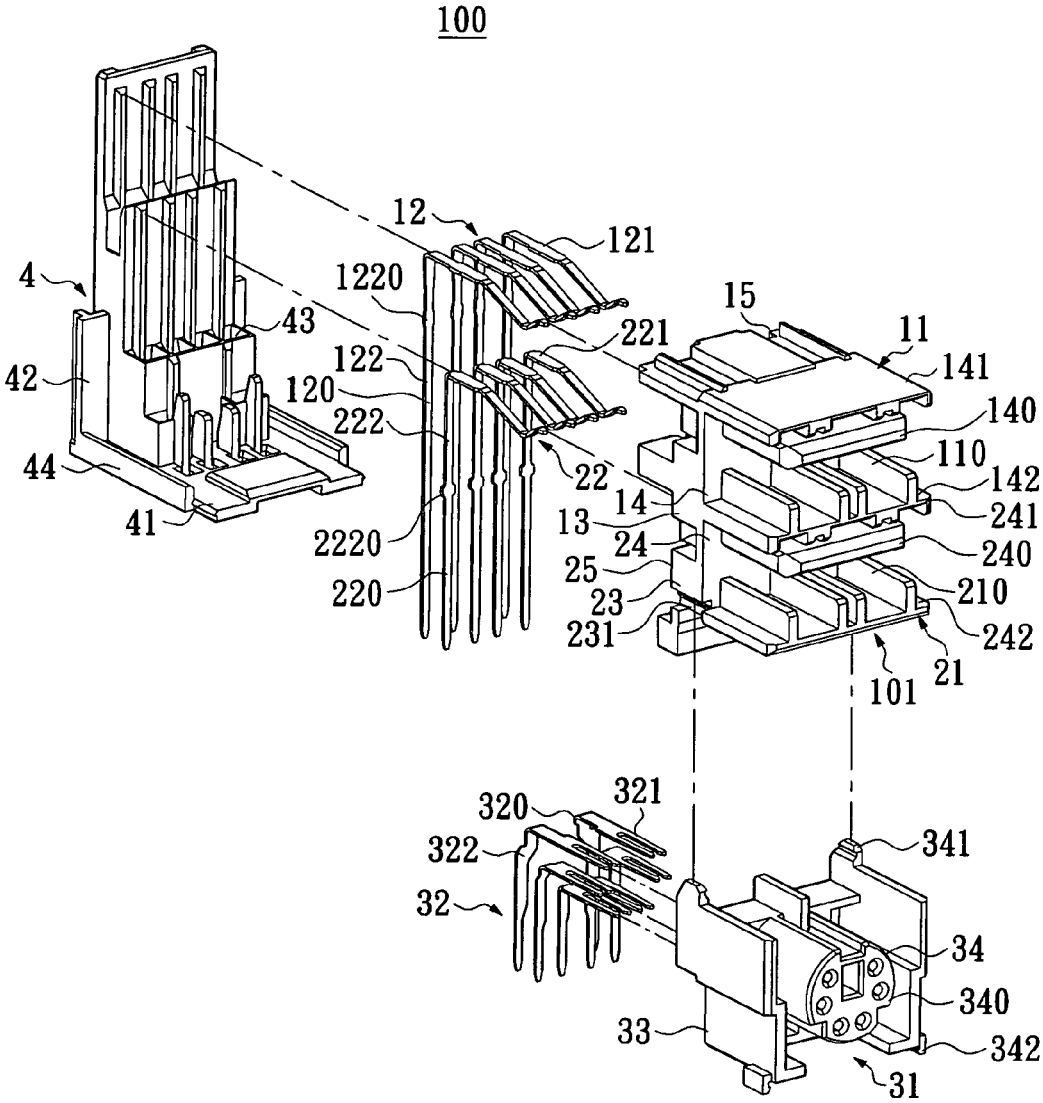
FIG. 2 is an exploded perspective view of the electrical connector module in FIG. 1, after a shielding shell is removed.
Figure 3:
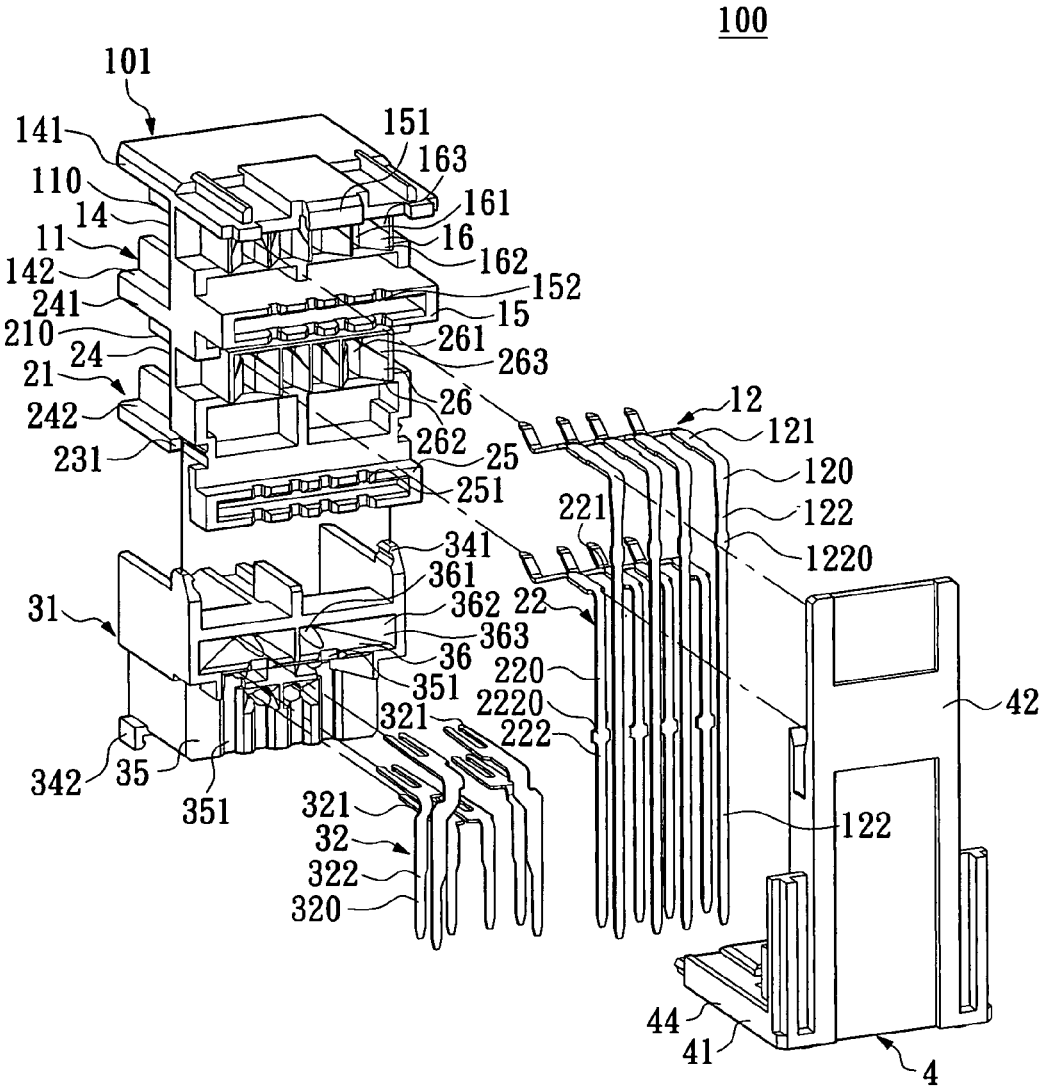
FIG. 3 is an exploded rear perspective view of the electrical connector module in FIG. 1, after the shielding shell is removed.

Please refer to FIGS. 1-3, the electrical connector module 100 of the present invention includes a first electrical connector 1, a second electrical connector 2, a third electrical connector 3 and a shielding shell 5 covering the electrical connector module 100. In the embodiment, the first electrical connector 1, the second electrical connector 2 and the third electrical connector 3 are overlapping up and down, and the first electrical connector 1 and the second electrical connector 2 are USB connectors with the same specification and the same structure and function. Of course, in other embodiments, the first electrical connector 1 and the second electrical connector 2 may also be connectors with the same or similar specification and the same or similar structure and function, such as 1394 connectors, ESATA connectors and so on.

Please refer to FIGS. 1-5, the first electrical connector 1 has a first housing 11 and a first conductive terminal group 12 which is received in the first housing 11 and has a plurality of first conductive terminals 120. The first housing 11 has a first base portion 13 with a first contact surface 14 on a front end of the first base portion 13. A first tongue board 140 extends perpendicularly forward from the first contact surface 14, a first top wall 141 extends perpendicularly forward from a top end of the first contact surface 14, and a first bottom wall 142 extends perpendicularly forward from a bottom end of the first contact surface 14, wherein the first tongue board 140 is located between the first top wall 141 and the first bottom wall 142 and parallel to the first top wall 141 and the first bottom wall 142, thereby defining a first inserting surface 110. A rear end of the first housing 11, that is, the end of the first base portion 13 far away from the first contact surface 14, has a first mounting surface 15. The first housing 11 has a first terminal receiving portion 16 opened sideward, which includes at least two first fixing holes 161 extending forward from the rear end of the first housing 11 and at least two first guiding holes 162 formed in the rear end of the first housing 11, wherein each first guiding hole 162 partially overlaps at least one of the first fixing holes 161. In the embodiment, more concretely, a plurality of parallel first fixing holes 161 extends horizontally between the first mounting surface 15 and a front end face of the first tongue board 140, passes through the first base portion 13 and extends beneath a lower bottom surface of the first tongue board 140. Each first guiding hole 162 surrounds one of the first fixing holes 161. Each first guiding hole 162 has at least one first guiding surface 163 connected with the corresponding first fixing hole 161. At least one of the first guiding surfaces 163 of each first guiding hole 162 has a different inclined angle. The first mounting surface 15 has at least one fastening portion 151 extending outward from its top end and a plurality of first terminal fastening grooves 152 formed in its bottom.

Please refer to FIGS. 1-5, the second electrical connector 2 has a second housing 21 and a second conductive terminal group 22 which is received in the second housing 21 and has a plurality of second conductive terminals 220. The second housing 21 has a second base portion 23 with a second contact surface 24 on a front end of the second base portion 23. A second tongue board 240 extends forward from the second contact surface 24, a second top wall 241 extends perpendicularly forward from a top end of the second contact surface 24, and a second bottom wall 242 extends perpendicularly forward from a bottom end of the second contact surface 24, wherein the second tongue board 240 is located between the second top wall 241 and the second bottom wall 242 and parallel to the second top wall 241 and the second bottom wall 242, thereby defining a second inserting surface 210. A rear end of the second housing 21, that is, the end of the second base portion 23 far away from the second contact surface 24, has a second mounting surface 25. The second housing 21 has a second terminal receiving portion 26 opened sideward, which includes at least two second fixing holes 261 extending forward from the rear end of the second housing 21 and at least two second guiding holes 262 formed in the rear end of the second housing 21, wherein each second guiding hole 262 partially overlaps at least one of the second fixing holes 261. In the embodiment, more concretely, a plurality of parallel second fixing holes 261 extends horizontally between the second mounting surface 25 and a front end face of the second tongue board 240, passes through the second base portion 23 and extends beneath a lower bottom surface of the second tongue board 240. Each second guiding hole 262 surrounds one of the second fixing holes 261. Each second guiding hole 262 has at least one second guiding surface 263 connected with the corresponding second fixing hole 261. At least one of the second guiding surfaces 263 of each second guiding hole 262 has a different inclined angle. The second mounting surface 25 has a plurality of second terminal fastening grooves 251 formed in its bottom, and the second base portion 23 has at least one concave fastening portion 231 formed in a bottom of each of two opposite sides thereof.

Please refer to FIGS. 2-5, in the embodiment, the first housing 11 and the second housing 21 are overlapping up and down and formed integrally, thereby forming a main body 101 of the electrical connector module 100. That is, the first electrical connector 1 and the second electrical 2 are overlapping up and down, the first bottom wall 142 is the second top wall 241 and the first contact surface 14 and the second contact surface 24 are located in the same plane. (Of course, the first housing 11 and the second housing 21 may also be separately formed, and then assembled when used.) Since the first electrical connector 1 and the second electrical connector 2 are USB connectors with the same specification, the first tongue board 140 and the second tongue board 240 have generally the same length, and each first fixing hole 161 and the corresponding second fixing hole 261, which correspond to each other up and down, have center lines which are located on one straight vertical line. The distance between the first mounting surface 15 and the first contact surface 14 is longer than that between the second mounting surface 25 and the second contact surface 24.

Please refer to FIGS. 1-3 and FIGS. 6-7, the third electrical connector 3 has a third housing 31 and a third conductive terminal group 32 which is received in the third housing 31 and has a plurality of third conductive terminals 320. The third housing 31 has a third base portion 33 and a socket body 34 extending forward from the third base portion 33. The socket body 34 has a third contact surface 340 formed on one of its end far away from the third base portion 33. A rear end of the third housing 31, that is, the end of the third base portion 33 far away from the third contact surface 340, has a third mounting surface 35. The third housing 31 has a third terminal receiving portion 36 opened sideward, which includes at least two third fixing holes 361 extending forward from the rear end of the third housing 31 and at least two third guiding holes 362 formed in the rear end of the third housing 31, wherein each third guiding hole 362 partially overlaps at least one of the third fixing holes 361. In the embodiment, more concretely, a plurality of third fixing holes 361 extends horizontally between the third mounting surface 35 and the third contact surface 340, and passes through the third base portion 33 and the socket body 34. In the embodiment, the third mounting surface 35 is a step-shaped surface, that is, the bottom of the third mounting surface 35 has a concave shape. Six third fixing holes 361 are arranged in three rows from up to down in the third housing 31. There is very small misalignment between the three rows of the third fixing holes 361. The ends of the upper row of two third fixing holes 361 extend through the outward protruding portion of the third mounting surface 35 and the ends of the middle rows and the lower rows of fixing holes 361 extend through the inward concave portion of the third mounting surface 35. Each of the third guiding holes 362 has at least one third guiding surface 363 connected with one of the third fixing holes 361. At least one of the third guiding surfaces 363 of each third guiding hole 362 has a different inclined angle. The third housing 31 has a plurality of third terminal grooves 351 formed therein, which is respectively correspondingly connected with the corresponding third fixing holes 361. The other end of each third terminal groove 351 extends to the bottom of the third housing 31. The third base portion 33 has two hook portions 341 respectively extending upward from tops of two of its sides and two locking grooves 342 respectively extending downward form a bottom of the third base portion 33.

Please refer to FIGS. 1-3, the third housing 31 overlaps the main body 101. The electrical connector module 100 further includes a rear seat 4 and a shielding shell 5. The rear seat 4 may engage with the third housing 31 and the main body 101 to fix the terminals better. The rear seat 4 is L-shaped and includes a horizontal main board 41 and a vertical board 42 perpendicular to the horizontal main board 41. In the vertical board 42, four rows of terminal positioning holes 43 are formed and vertically extend through the main board 41. Two blocking walls 44 extend vertically upward from two lateral edges of the main board 41, respectively. The shielding shell 5 bushes the third housing 31, the main body 101 and the rear seat 4.

Figure 4:
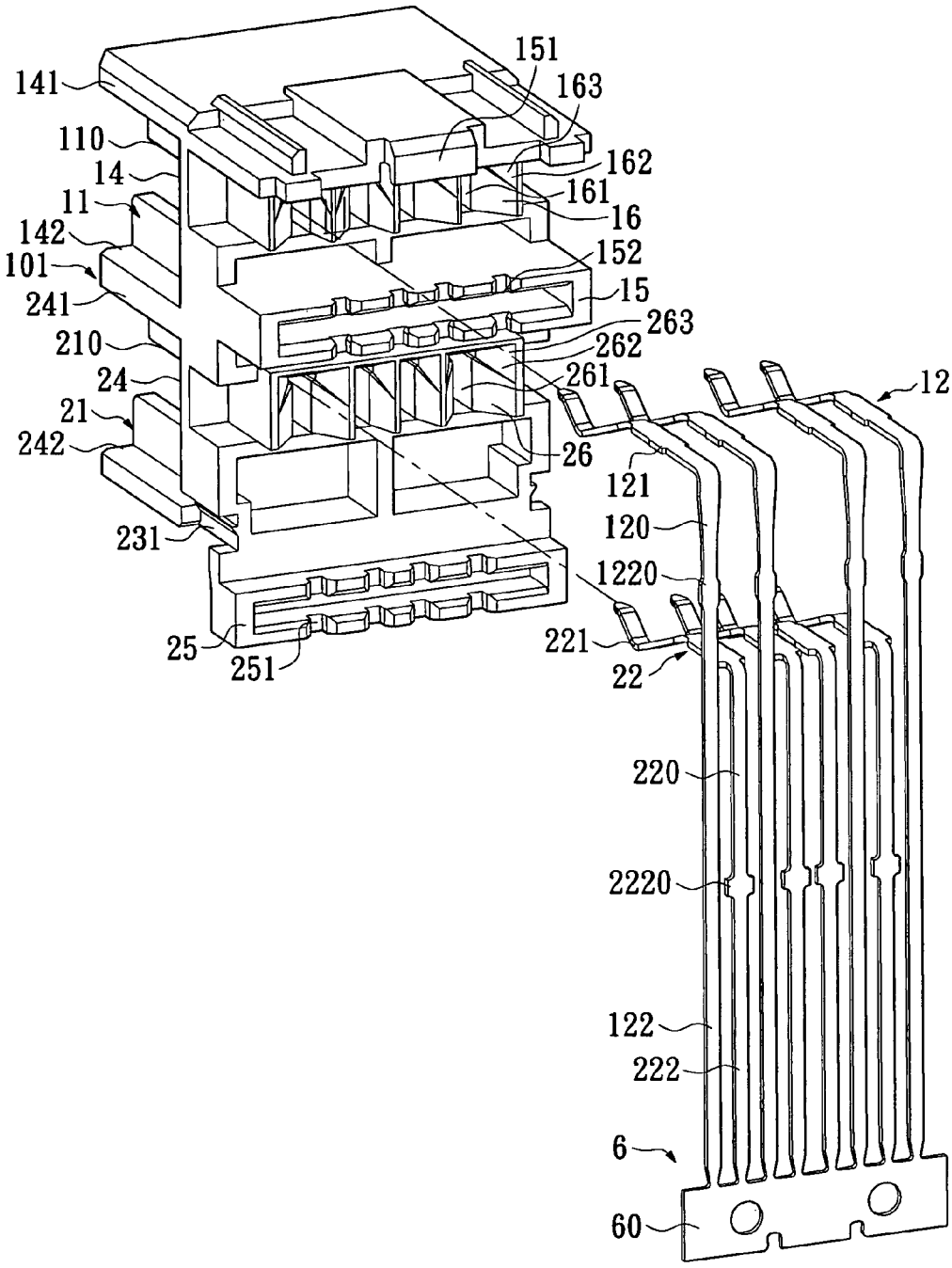
FIG. 4 is a schematic perspective view of a main body and a first carrier structure of the electrical connector module in FIG. 1, before assembly.
Figure 5:
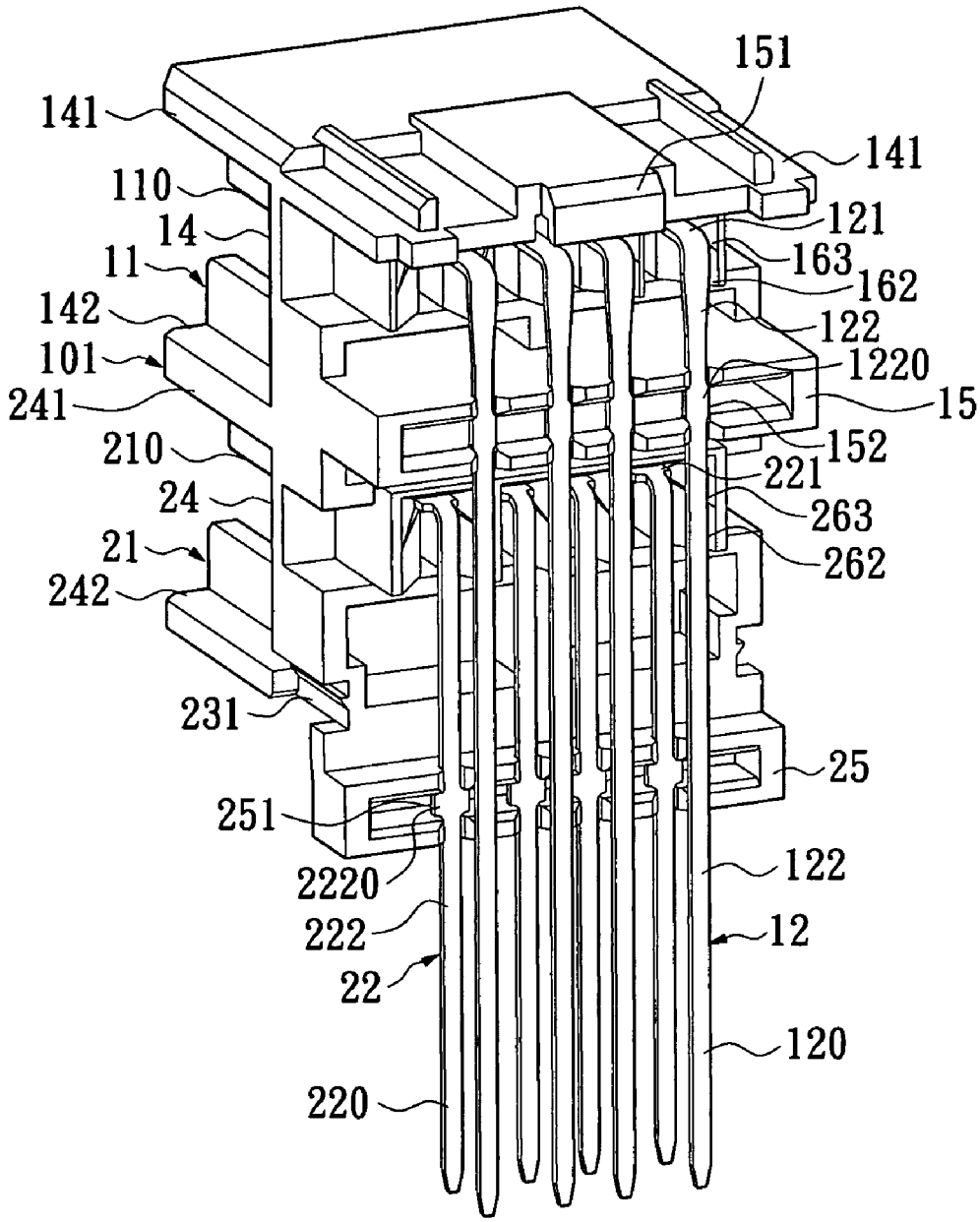
FIG. 5 is a schematic assembled perspective view of the main body, a first conductive terminal group and a second conductive terminal group of the electrical connector module in FIG. 1.
Figure 16:
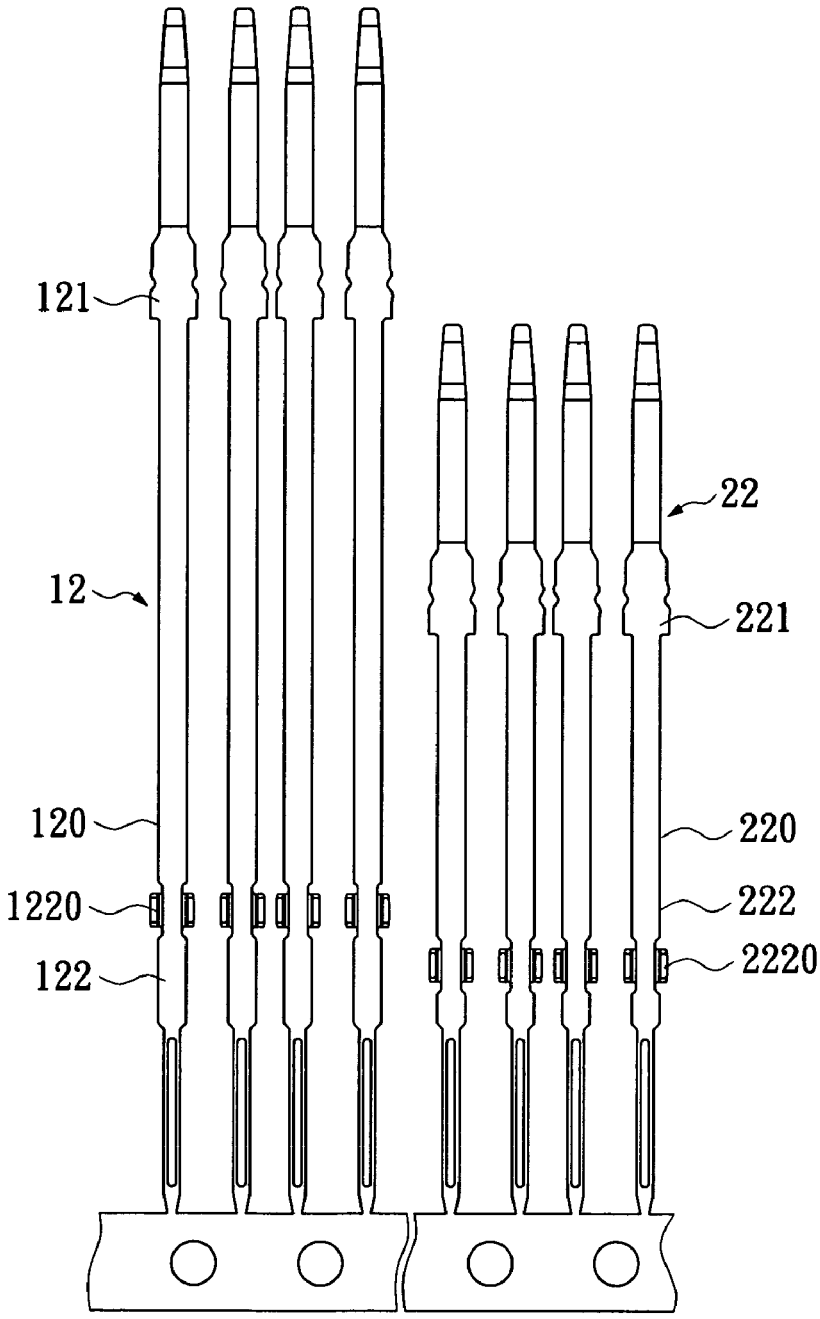
FIG. 16 is a schematic view showing that conventional first conductive terminals and second conductive terminals are respectively formed on different terminal carrier structures in the electrical connector module in FIG. 1.
Figure 17:
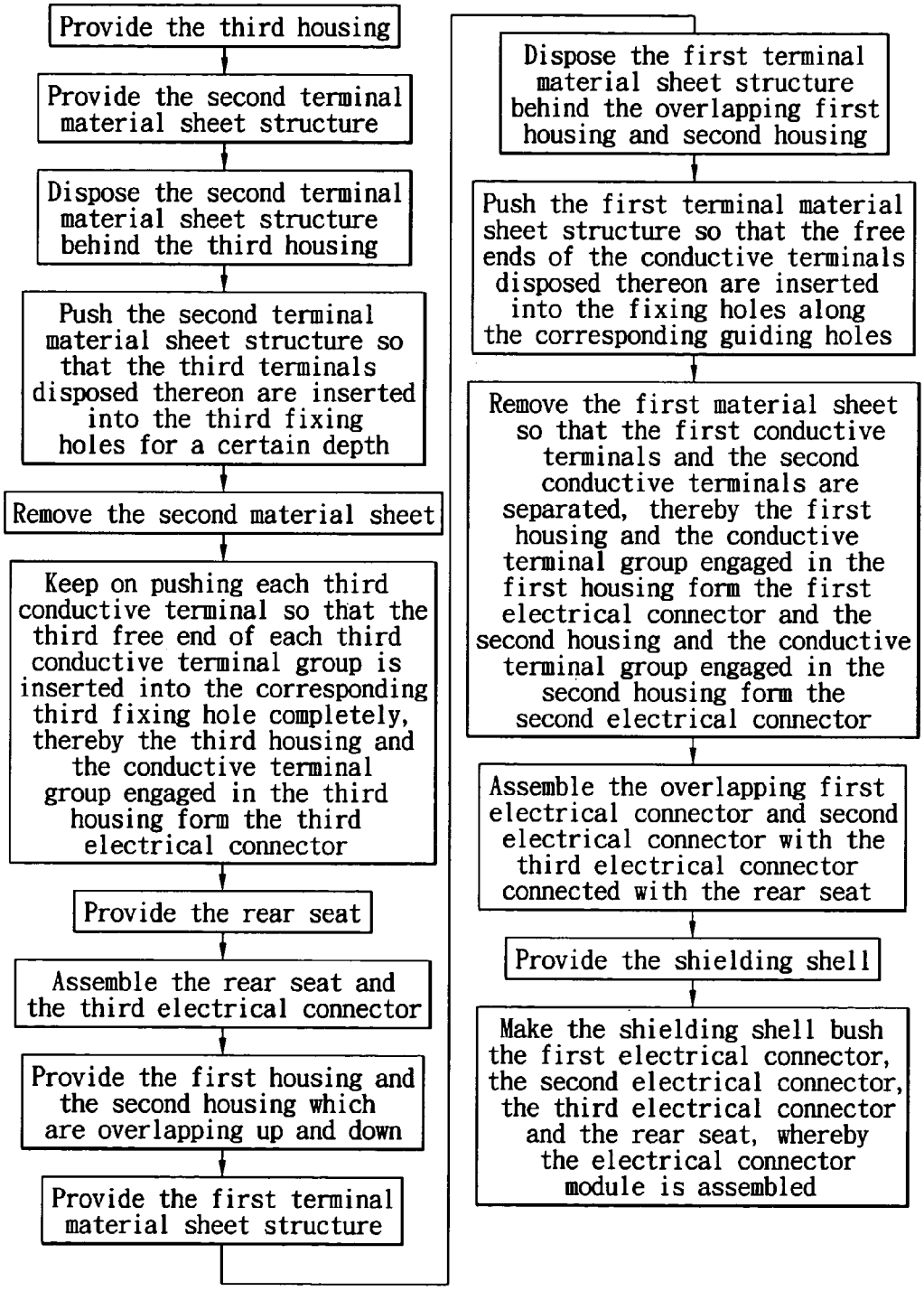
FIG. 17 is a flow chart of assembling the electrical connector module by method of assembling conductive terminals of a plurality of electrical connectors according to the present invention.
Figure 18:
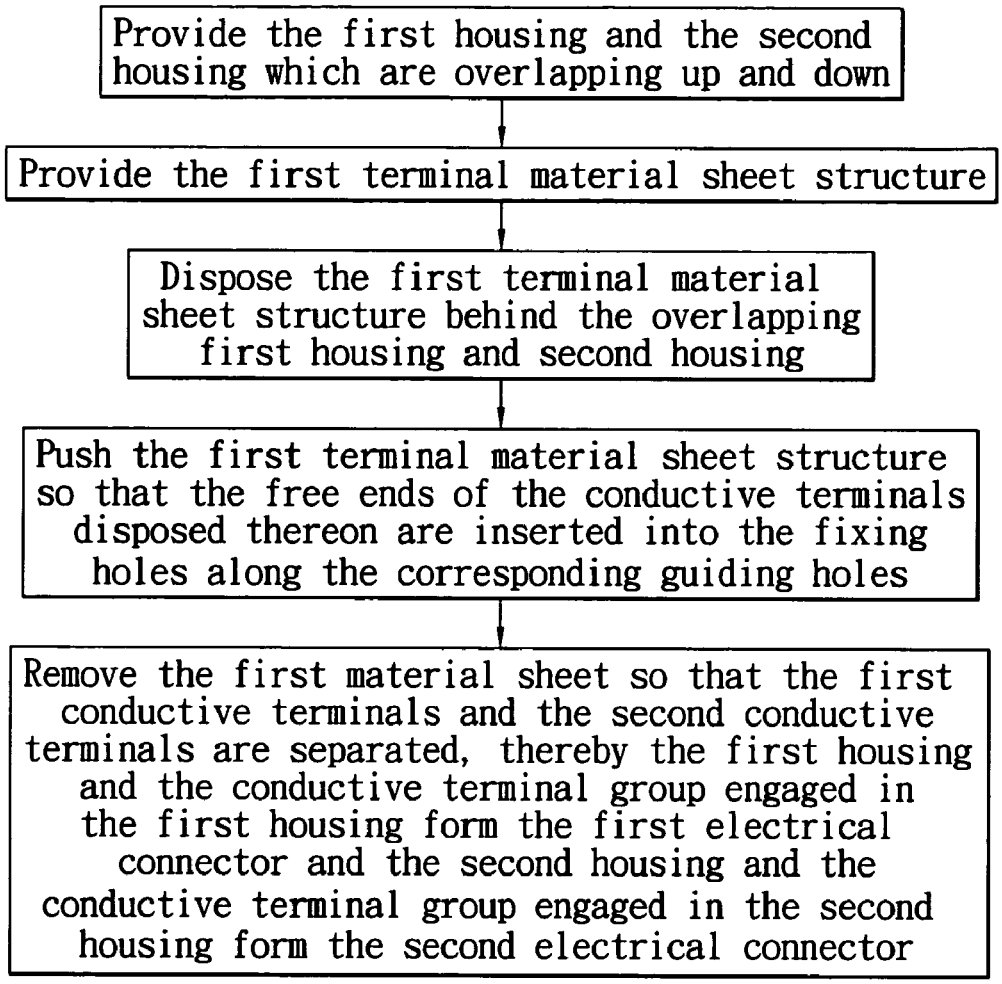
FIG. 18 is a flow chart of assembling the conductive terminals of the plurality of electrical connectors according to the present invention.
Figure 19:
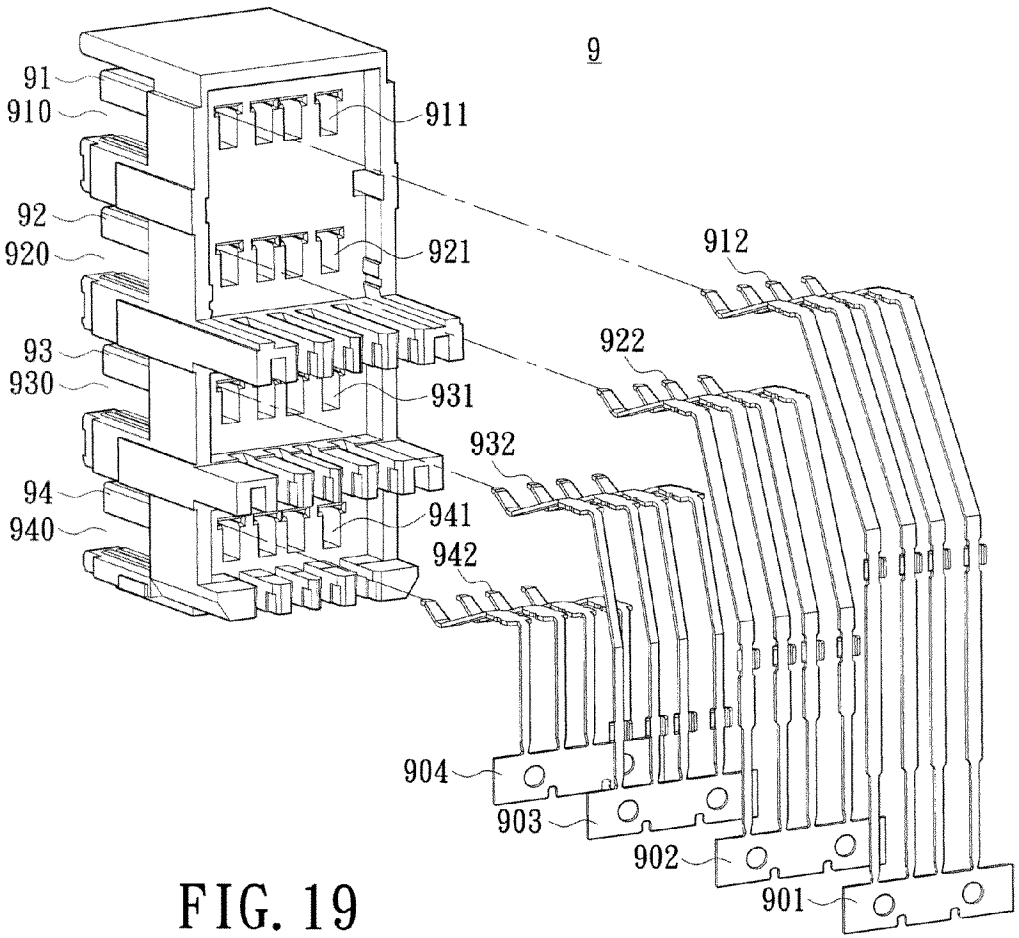
FIG. 19 PRIOR ART
FIG. 19 is a schematic perspective view of a main body and corresponding four strips of terminal carrier structures of a conventional electrical connector module, before assembly.
Figure 20:
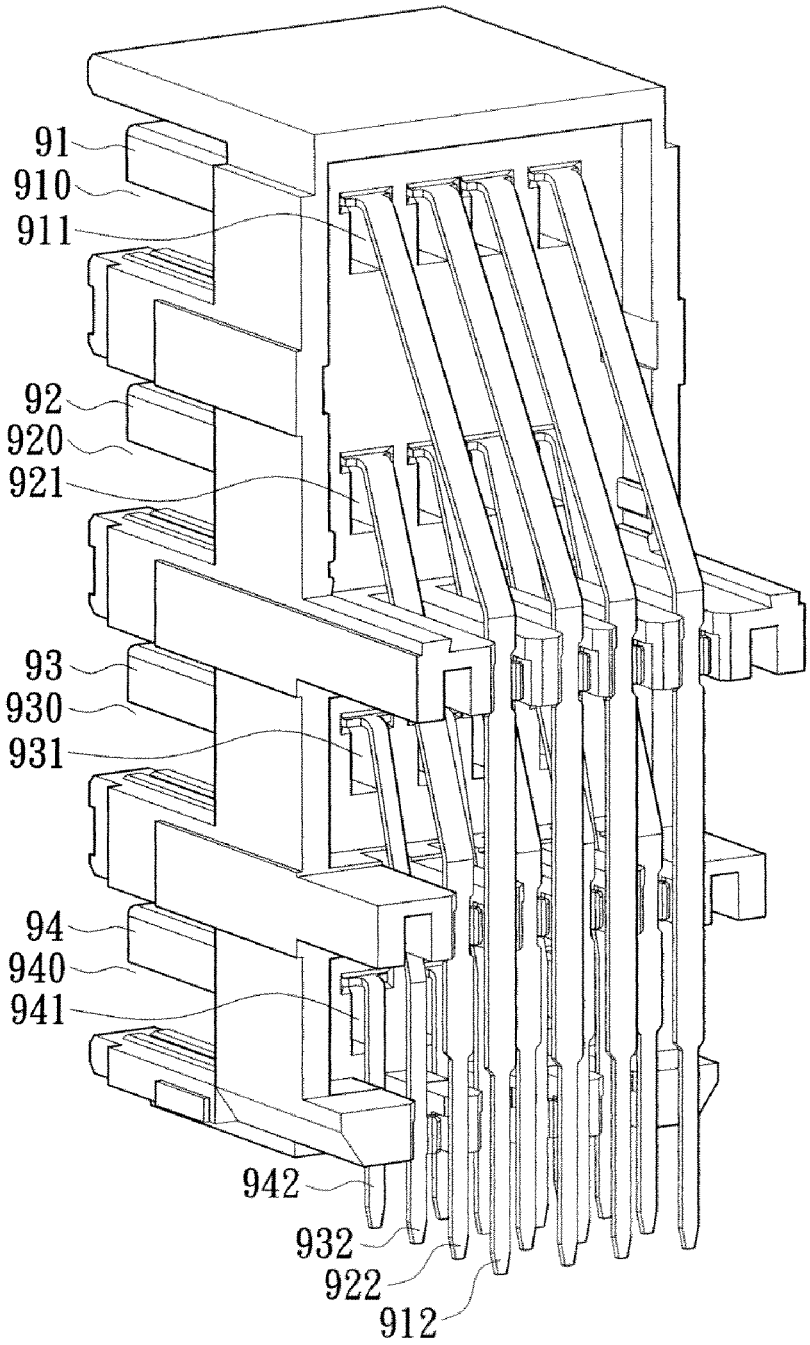
FIG. 20 PRIOR ART
FIG. 20 is a schematic assembled perspective view of the main body and corresponding four groups of conductive terminals of the electrical connector module in FIG. 19.

Please refer to FIGS. 4-5, the second conductive terminals 220 and the first conductive terminals 120 have generally the same structure and are integrally formed on a first terminal carrier structure 6. In the embodiment, the distance between two adjacent first conductive terminal 120 and second conductive terminal 220 is smaller than that between two adjacent conductive terminals which are separately formed on different terminal carrier structures (please refer to FIG. 16 simultaneously), so the whole length of the first terminal carrier structure 6 is smaller than the total length of the two terminal carrier structures on which the first conductive terminals 120 and the second conductive terminals 220 are separately formed, and the width of the first terminal carrier structure 6 is equal to that of the terminal carrier structure on which the first conductive terminals 120 is separately formed. In other words, in this kind of connector (such as USB connector, 1394 connector and ESATA connector etc.), the distance between adjacent conductive terminals is greater than the width of each conductive terminal, so three second conductive terminals 220 may be formed between four first conductive terminals 120 on the terminal carrier structure on which original first conductive terminals 120 are formed separately. Accordingly, the three second conductive terminals 220 may be formed by original abandoned material and the fourth second conductive terminal may be formed on the lengthened portion for the terminal carrier structure on which original first conductive terminals 120 are formed separately, wherein the length of the lengthened portion for the terminal carrier structure is slightly greater than the width of one second conductive terminal 220, thereby improving the material utilization rate of the terminal carrier structure greatly, reducing unnecessary waste and manufacturing cost.

Please refer to FIGS. 2-5, the first terminal carrier structure 6 has a first carrier 60 on which the first conductive terminal group 12 and the second conductive terminal group 22 are formed alternately. The first conductive terminal group 12 has four first conductive terminals 120 and the second conductive terminal group 22 has four second conductive terminals 220. Each first conductive terminal 120 has a first free end 121 extending therefrom. In the embodiment, the first free end 121 of each first conductive terminal 120 is a first fixing portion 121 to be fixed in one of the first fixing holes 161. A first carrier disconnected portion 122 extends from each first fixing portion 121. The first carrier disconnected portion 122 is extended out of the first housing 11 from the first fixing hole 161 through the first guiding hole 162. Each first carrier disconnected portion 122 has a first positioning portion 1220. Each second conductive terminal 220 has a second free end 221 extending therefrom. In the embodiment, the second free end 221 of each second conductive terminal 220 is a second fixing portion 221 to be fixed in one of the second fixing hole 261. A second carrier disconnected portion 222 extends from each second fixing portion 221. The second carrier disconnected portion 222 is extended out of the second housing 21 from the second fixing hole 261 through the second guiding hole 262. Each second carrier disconnected portion 222 has a second positioning portion 2220. There is height difference between the position of each first free end 121 of the first conductive terminal group 12 and the position of each second free end 221 of the second conductive terminal group 22. Each free end 121, 221 of each conductive terminal group 12, 22 respectively corresponds to one of the guiding holes 162, 262 of one of the terminal receiving portions 16, 26. The carrier disconnected portions 122, 222 of the two electrical connectors 1, 2 are connected with the first carrier 60.

For convenient assembly, the first conductive terminal group 12 and the second conductive terminal group 22 are arranged on the first terminal carrier structure 6 according to the arbitrary arrangement rules as follows: 1) one or two conductive terminals 220, 120 of one of the conductive terminal groups 22, 12 are formed between two adjacent conductive terminals 120, 220 of the other conductive terminal group 12, 22 on the first terminal carrier structure 6; 2) one conductive terminal 120, 220 of one of the conductive terminal groups 12, 22 is adjacent to one conductive terminal 220, 120 of the other conductive terminal group 22, 12 on the first terminal carrier structure 6; 3) two conductive terminals 120, 220 of one of the conductive terminal groups 12, 22 are located on two outer sides of the first terminal carrier structure 6, respectively. The embodiment has four preferred arrangement modes, as shown in detail in FIGS. 8-15. After the first terminal carrier structure 6 is formed, the first free end 121 and the first carrier disconnected portion 122 of each first conductive terminal 120 and the second free end 221 and the second carrier disconnected portion 222 of each second conductive terminal 220 are "]"-shaped, and the bent point of each first conductive terminal 120 is located higher than the bent point of each second conductive terminal 220, that is, the length of the first carrier disconnected portion 122 is greater than that of the second carrier disconnected portion 222. So the first free-ends 121 of the first conductive terminal group 12 are located above the second free ends 221 of the second conductive terminal group 22. Further, the length of each first free end 121 is greater than that of each second free end 221.

Figure 6:
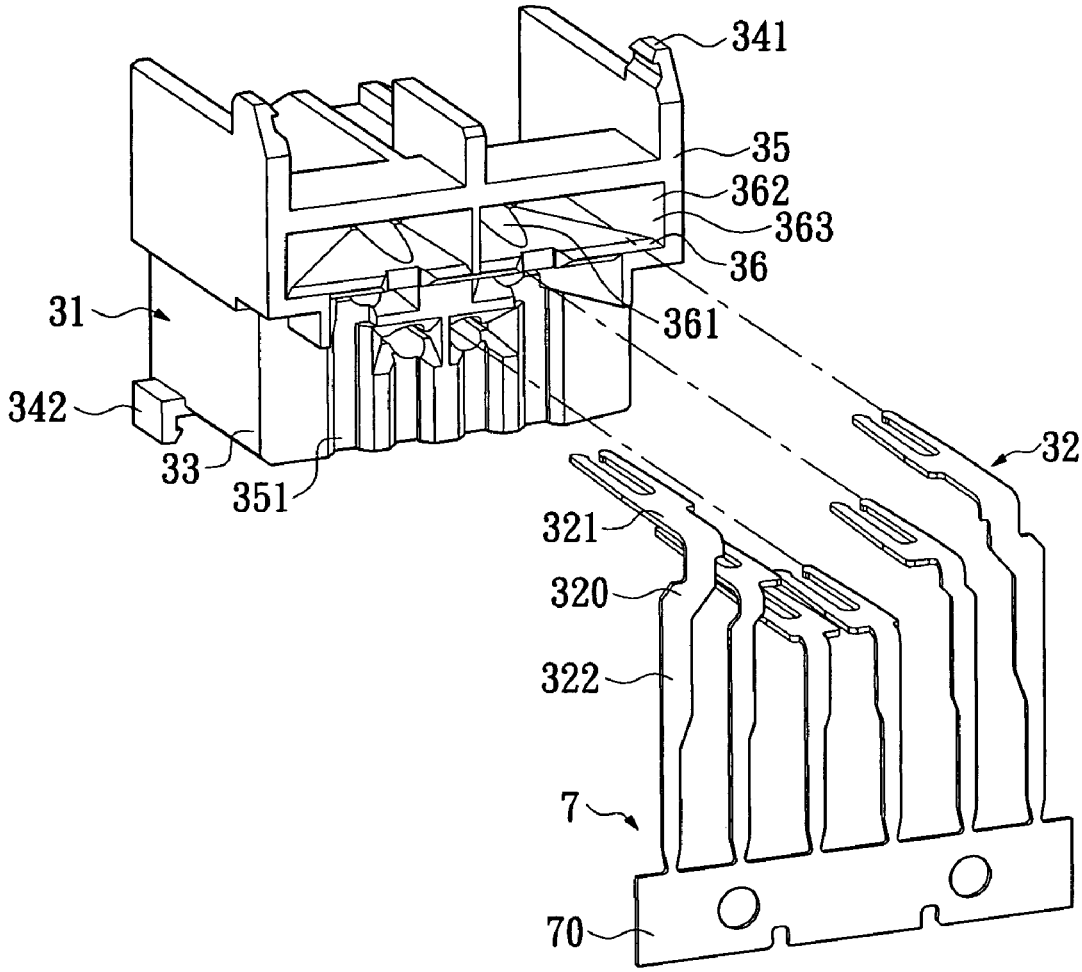
FIG. 6 is a schematic perspective view of a third housing and a second terminal carrier structure of the electrical connector module in FIG. 1, before assembly.
Figure 7:
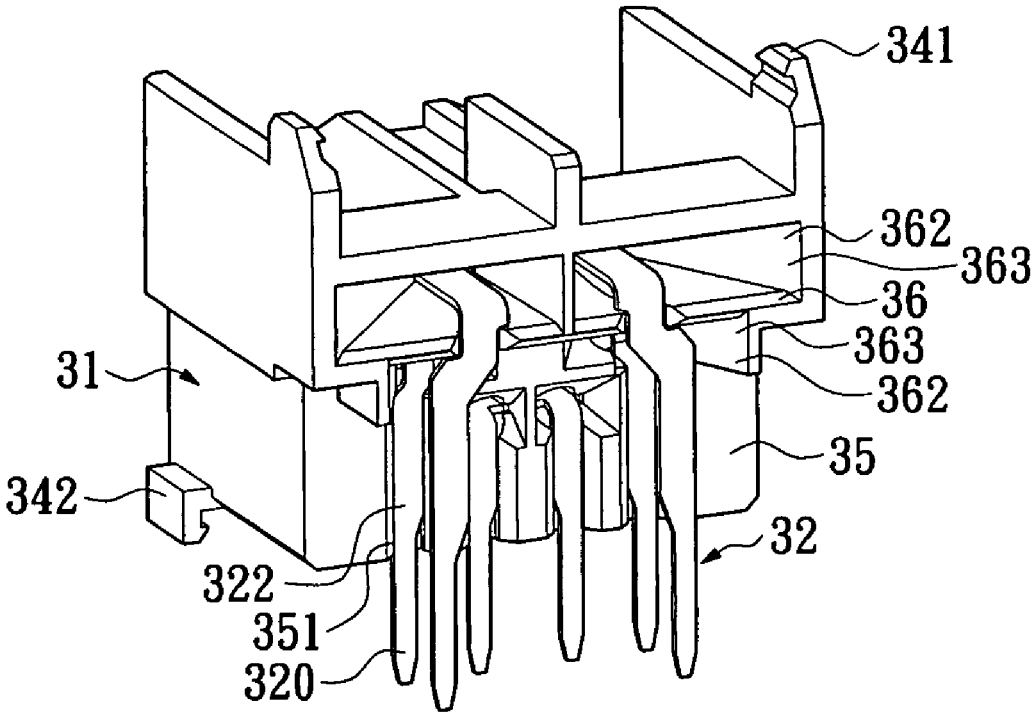
FIG. 7 is a schematic assembled perspective view of the third housing and a third conductive terminal group of the electrical connector module in FIG. 1.
Figure 8:
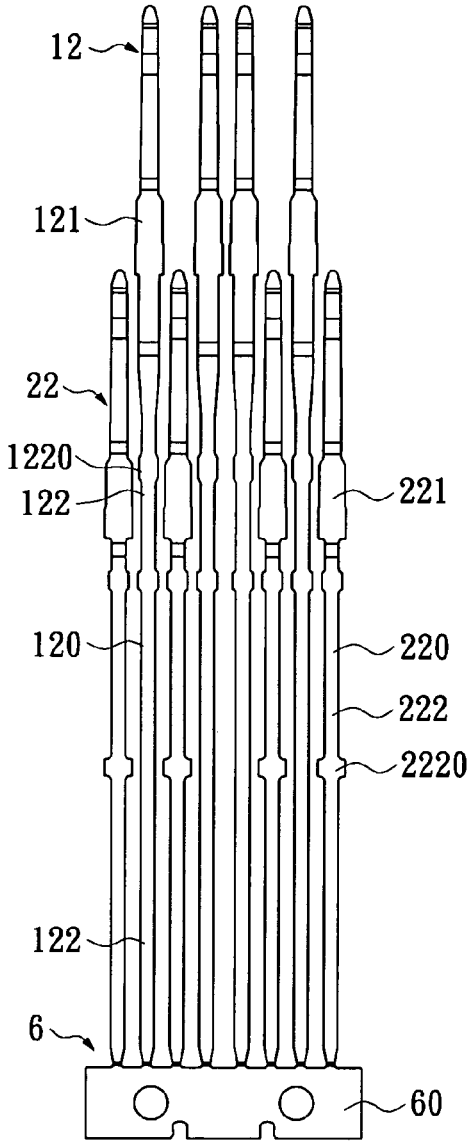
FIG. 8 is a front view of the first arrangement mode of the conductive terminals of the first terminal carrier structure of the electrical connector module in FIG. 1, before the conductive terminals are bent.
Figure 9:
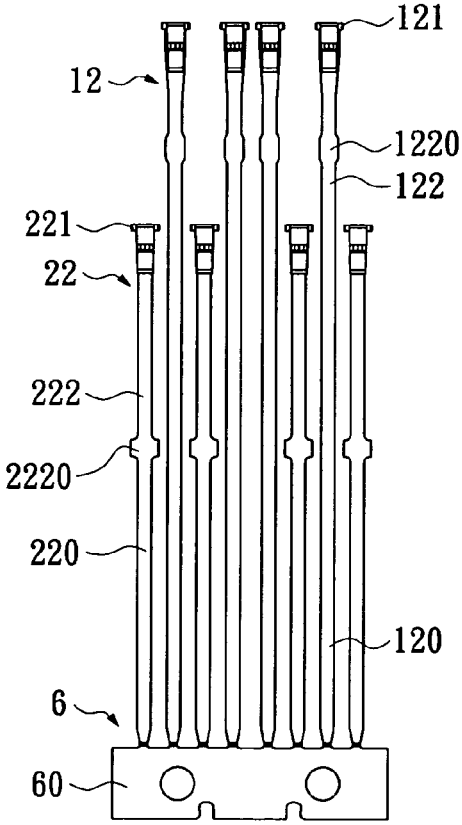
FIG. 9 is a front view of the first arrangement mode of the conductive terminals of the first terminal carrier structure of the electrical connector module in FIG. 8, after the conductive terminals are bent.
Figure 10:
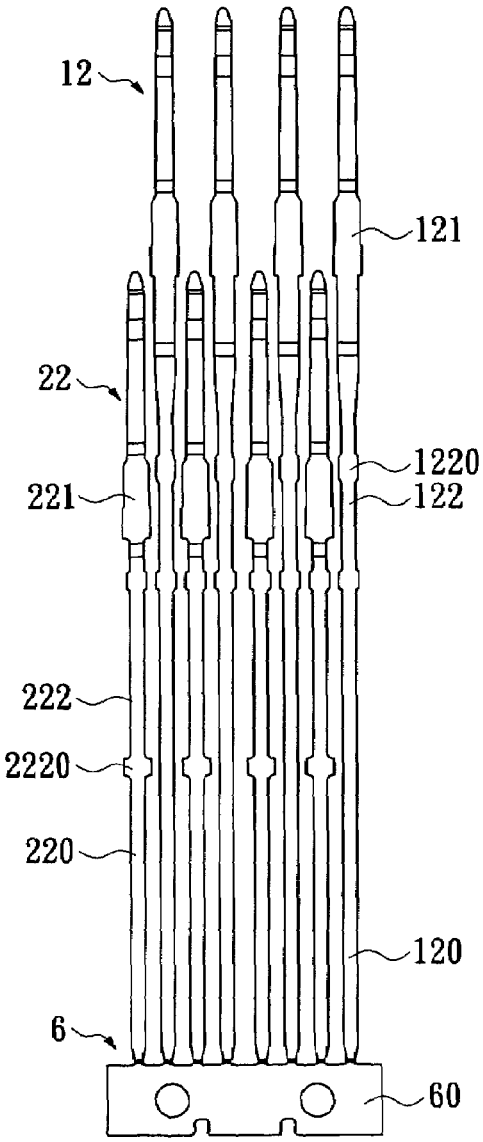
FIG. 10 is a front view of the second arrangement mode of the conductive terminals of the first terminal carrier structure of the electrical connector module in FIG. 1, before the conductive terminals are bent.
Figure 11:
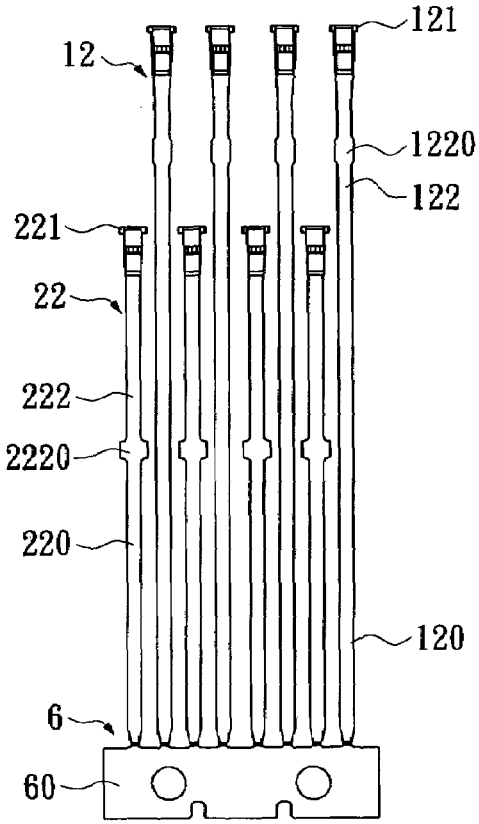
FIG. 11 is a front view of the second arrangement mode of the conductive terminals of the first terminal carrier structure of the electrical connector module in FIG. 10, after the conductive terminals are bent.
Figure 12:
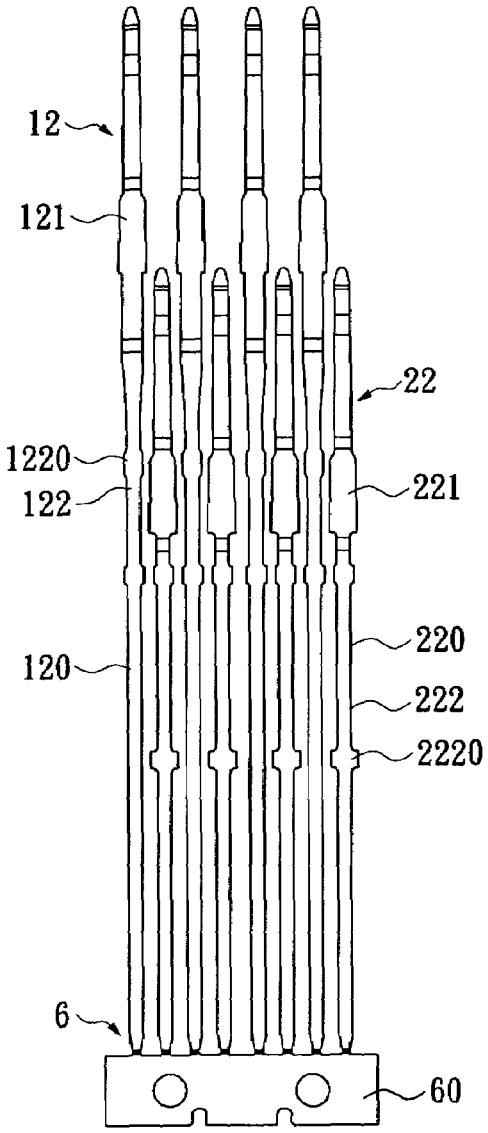
FIG. 12 is a front view of the third arrangement mode of the conductive terminals of the first terminal carrier structure of the electrical connector module in FIG. 1, before the conductive terminals are bent.
Figure 13:
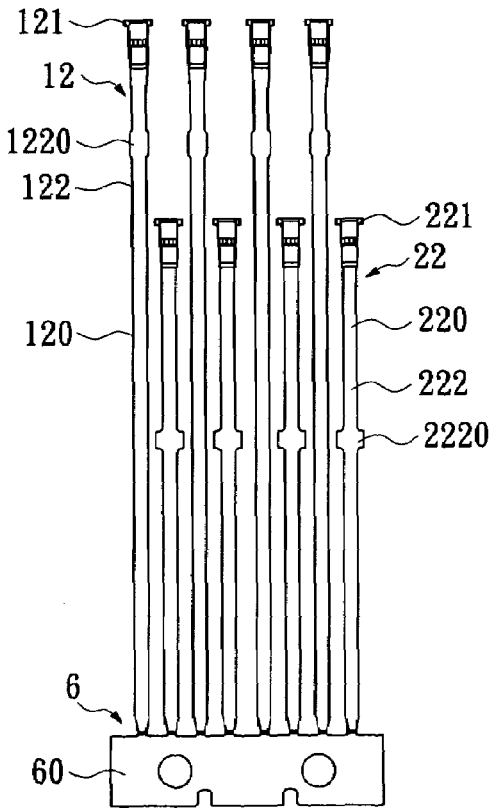
FIG. 13 is a front view of the third arrangement mode of the conductive terminals of the first terminal carrier structure of the electrical connector module in FIG. 12, after the conductive terminals are bent.
Figure 14:
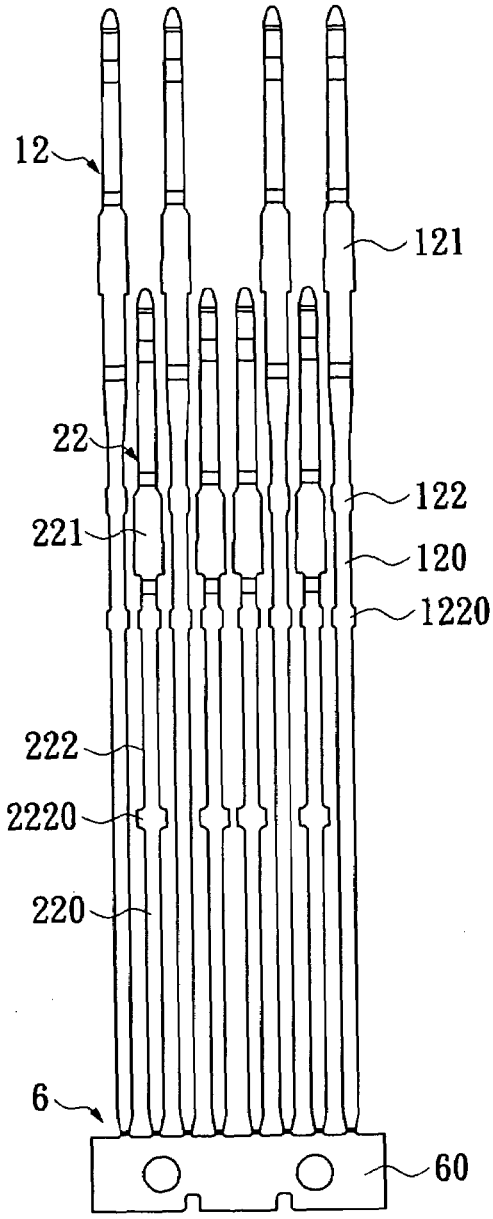
FIG. 14 is a front view of the fourth arrangement mode of the conductive terminals of the first terminal carrier structure of the electrical connector module in FIG. 1, before the conductive terminals are bent.
Figure 15:
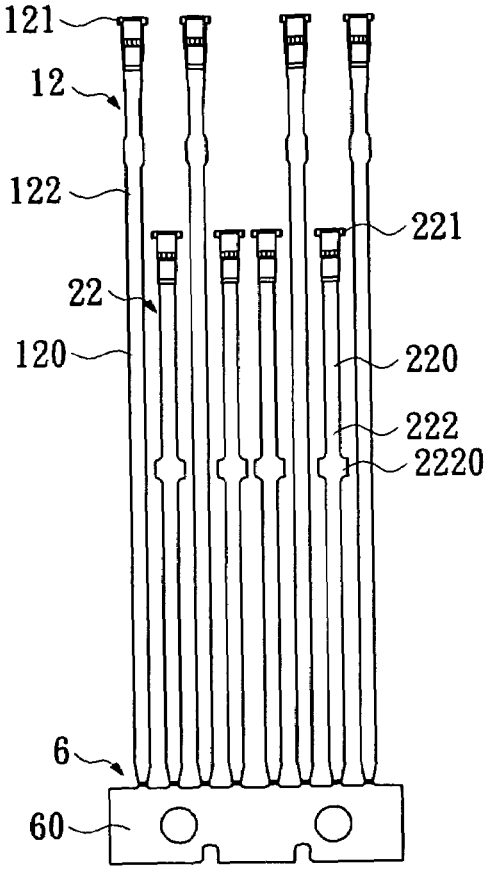
FIG. 15 is a front view of the fourth arrangement mode of the conductive terminals of the first terminal carrier structure of the electrical connector module in FIG. 14, after the conductive terminals are bent.

Please refer to FIGS. 6-7, the third conductive terminal group 32 is integrally formed on the second terminal carrier structure 7. The second terminal carrier structure 7 has a second carrier 70. Each third conductive terminal 320 has a third free end 321 extending therefrom, in the embodiment, the third free end 321 of each third conductive terminal 320 is a third fixing portion 321 to be fixed in one of the third fixing holes 361. A third carrier disconnected portion 322 extends from each third fixing portion 321. The third carrier disconnected portion 322 is extended out of the third housing 31 from the third fixing hole 361 through the third guiding hole 362. Each third carrier disconnected portion 322 is connected with the second carrier 70, wherein the third free end 321 is generally perpendicular to the third carrier disconnected portion 322. For convenient assembly, corresponding to the three rows of third fixing holes 361, the third free ends 321 of the six third conductive terminals 320, from the bilateral third conductive terminals 320 to the middle third conductive terminals 320, are arranged in three rows from up to down in turn. Because there is very small misalignment between the three rows of third conductive terminals 320 in the vertical direction, that is, the misalignment between the third free ends 321 of the three rows of third conductive terminals 320 is very small, so the third carrier disconnected portions 322 of the third conductive terminals 320 which are located on the outer sides in the upper row and the middle row are bent to be "ㄣ"-shaped.

Please refer to FIGS. 2-3, FIGS. 6-7 and FIG. 17, in assembly, firstly provide the third housing 31 and the second terminal carrier structure 7 and dispose the second terminal carrier structure 7 behind the third housing 31, so that the third free end 321 of each third conductive terminal 320 is located behind one of the third guiding holes 362, correspondingly. Push the second terminal carrier structure 7 in order that the third free end 321 of each third conductive terminal 320 enters the corresponding third fixing hole 361 along the third guiding surface 363 of the corresponding third guiding hole 362. After each third conductive terminal 320 is inserted into the corresponding third fixing hole 361 for a certain depth, remove the second carrier 70 so that each third conductive terminal 320 are separated from the second carrier 70. Then, keep on pushing each third conductive terminal 320 so that the third free end 321 of each third conductive terminal group 32 is inserted into the corresponding third fixing hole 361 completely, thereby the third housing 31 and the third conductive terminal group 32 form the third electrical connector 3 and each third conductive terminal 320 doesn't need to be riveted further. Accordingly, one end of the third free end 321 of each third conductive terminal 320 located in the upper row, which is close to the third carrier disconnected portion 322, extends rearward for a length greater than that of the end of the third free end 321 of each third conductive terminal 320 located in the middle low and the lower row, which is close to the third carrier disconnected portion 322. The third carrier disconnected portions 322 of the middle row and the lower row of the third conductive terminals 320 extend in the same plane. The third carrier disconnected portions 322 of the upper row of the third conductive terminals 320 are located outside the third carrier disconnected portions 322 of the middle row and the lower row of the third conductive terminals 320.

Please refer to FIGS. 2-3, subsequently, provide the rear seat 4, align the third carrier disconnected portion 322 of each third conductive terminal 320 with the corresponding positioning hole 43 in the rear seat 4, and push the rear seat 4 towards the bottom of the third housing 31, so that the horizontal main body 41 of the rear seat 4 engages with the locking grooves 342 in the bottom of the third housing 31 and the blocking walls 44 are locked on two lateral edges of the third housing 31. Thereby, the rear seat 4 and the third electrical connector 3 are assembled.

Please refer to FIGS. 2-5 and FIG. 18, subsequently, provide the first housing 11 and the second housing 21 which are overlapping up and down, and further provide the first terminal carrier structure 6. Dispose the first terminal carrier structure 6 behind the overlapping first housing 11 and second housing 21 so that the first free end 121 of each first conductive terminal 120 and the second free end 221 of each second conductive terminal 220 are respectively located behind one of the first guiding holes 162 and one of the second guiding holes 262. Push the first terminal carrier structure 6 in order that the first free end 121 of each first conductive terminal 120 and the second free end 221 of each second conductive terminal 220 are inserted into the first fixing hole 161 and the second fixing hole 261 along the corresponding first guiding hole 162 and the corresponding second guiding hole 262. Remove the first carrier 60 so that the first conductive terminals 120 and the second conductive terminals 220 are separated from the first carrier 60 and each housing 11, 21 is inserted into one of the first conductive terminal group 12 and the second conductive terminal group 22, respectively, thereby the first electrical connector 1 and the second electrical connector 2 are formed, and each first conductive terminal 120 and each second conductive terminal 220 doesn't need to be riveted further. Accordingly, the first free ends 121 of the first conductive terminals 120 are located above the second free ends 221 of the second conductive terminals 220. The first positioning portions 1220 of the first carrier disconnected portions 122 and the second positioning portions 2220 of the second carrier disconnected portions 222 are respectively correspondingly locked and positioned in the first terminal fastening grooves 152 and the second terminal fastening grooves 252. One end of the first free end 121 of each first conductive terminal 120 close to the first carrier disconnected portion 122 extends rearward for a length greater than that of the end of the second free end 221 of each second conductive terminal 220 close to the second carrier disconnected portion 222. The first carrier disconnected portions 122 of the first conductive terminals 120 are located outside the second carrier disconnected portions 222 of the second conductive terminals 220, as shown in FIG. 5.

Please refer to FIGS. 1-3, subsequently, assemble the overlapping first electrical connector 1 and second electrical connector 2 with the third electrical connector 3 connected with the rear seat 4. In detail, align the first carrier disconnected portion 122 of each first conductive terminal 120 and the second carrier disconnected portion 222 of each second conductive terminal 220 with the corresponding positioning holes 43 in the rear seat 4, and align the hook portions 341 on the top of the third housing 31 with the concave fastening portions 231 on the two sides of the second base portion 23. Push the rear seat 4 towards the top of the main body 101 to engage with the fastening portion 151 on the top of the main body 101. At this time, the hook portions 341 are fastened on the concave fastening portions 231, correspondingly. So the first conductive terminals 120, the second conductive terminals 220 and the third conductive terminals 320 are arranged up and down in turn in five rows in the vertical direction and back and forth in four rows in the horizontal direction.

Please refer to FIGS. 1-3, finally, provide the shielding shell 5 and make the shielding shell 5 bush the first electrical connector 1, the second electrical connector 2, the third electrical connector 3 and the rear seat 4, whereby the electrical connector module 100 is assembled.

Consequently, the Method of assembling conductive terminals of a plurality of electrical connectors and electrical connector module assembled thereby of the present invention has the advantages as follows:

1. In the method of assembling conductive terminals of a plurality of electrical connectors and electrical connector module assembled thereby of the present invention, each guiding hole is selected to partially overlap at least one fixing hole and has at least one guiding surface connected with the fixing hole. The free end of each conductive terminal is inserted into the fixing hole along the corresponding guiding hole, that is, the guiding holes have the function of guiding the conductive terminals, so that the conductive terminals can be correctly correspondingly inserted in the corresponding fixing holes during assembly, even if the free ends of the conductive terminals cannot completely correspond to the corresponding fixing holes originally, thereby improving assembly speed and quality effectively.

2. In the method of assembling conductive terminals of a plurality of electrical connectors and electrical connector module assembled thereby of the present invention, the first conductive terminals 120 and the second conductive terminals 220 have generally the same structure and are integrally formed on the first terminal carrier structure 6. That is, three second conductive terminals 220 may be formed between four first conductive terminals 120 on the terminal carrier structure 6 on which original first conductive terminals 120 are formed separately. Accordingly, the three second conductive terminals 220 may be formed by original abandoned material and the fourth second conductive terminal may be formed on the lengthened portion of the terminal carrier structure on which original first conductive terminals 120 are formed separately, wherein the length of the lengthened portion of the terminal carrier structure is slightly greater than the width of one second conductive terminal 220, thereby improving the material utilization rate of the terminal carrier structure greatly, reducing unnecessary waste and reducing manufacturing cost.

3. The method of assembling conductive terminals of a plurality of electrical connectors and electrical connector module assembled thereby of the present invention includes the first conductive terminal group 12 and the second conductive terminal group 22 with different length. Further, the bent first conductive terminal group 12 and the bent second conductive terminal group 22 have different length and the free ends with different length. So the two conductive terminal groups 12, 22 can be alternately disposed on the first terminal carrier structure 6 and the whole structure of the conductive terminals is simple, thereby improving production efficiency and reducing manufacturing cost. The first conductive terminal group 12 and the second conductive terminal group 22 are alternately disposed on the same first terminal carrier structure 6, which simplifies the manufacturing process and ensures that the terminals can be assembled conveniently. Additionally, each housing and the conductive terminals received in the housing can form an electrical connector by one-insertion, in the embodiment, by one-insertion, the first housing 11 and the first conductive terminal group 12 received in the first housing 11 can form the first electrical connector 1 and the second housing 21 and the second conductive terminals 22 received in the second housing 21 can form the second electrical connector 2, thereby reducing the assembly procedure, improving the production efficiency, reducing manufacturing cost and improving assembly quality effectively.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A method of assembling conductive terminals of a plurality of electrical connectors, comprising the steps of:

(1) providing at least two housings which are overlapping up and down, wherein each housing has a terminal receiving portion opened sideward and the terminal receiving portion includes at least two fixing holes extending forward from a rear end of the housing and at least two guiding holes formed in the rear end of the housing, each guiding hole partially overlapping one of the fixing holes;

(2) providing a terminal carrier structure with a carrier, wherein at least two conductive terminal groups are alternately disposed on the carrier and each conductive terminal group has at least two conductive terminals each of which has a free end extending from, and there is height difference between the position of each free end of one of the conductive terminal groups and the position of each free end of the other conductive terminal group, and each free end of each conductive terminal group corresponds to one of the guiding holes of one of the terminal receiving portions, respectively;

(3) disposing the terminal carrier structure behind the overlapping at least two housings so that the free end of each conductive terminal is located behind one of the guiding holes, respectively;

(4) pushing the terminal carrier structure so that the free end of each conductive terminal is inserted into the corresponding fixing hole along the corresponding guiding hole; and (5) removing the carrier so that each conductive terminal is separated from the carrier and each housing and the conductive terminal group engaged in the housing form one electrical connector.

2. The method of assembling conductive terminals of a plurality of electrical connectors as claimed in claim 1, wherein the electrical connectors are electrical connectors of the same specification.

3. The method of assembling conductive terminals of a plurality of electrical connectors as claimed in claim 2, wherein the electrical connectors are USB connectors.

4. The method of assembling conductive terminals of a plurality of electrical connectors as claimed in claim 1, wherein at least two of the electrical connectors are combined to form an electrical connector module and overlapping up and down correspondingly.

5. The method of assembling conductive terminals of a plurality of electrical connectors as claimed in claim 4, wherein the housings are integrally formed.

6. The method of assembling conductive terminals of a plurality of electrical connectors as claimed in claim 4, wherein each housing is separately formed.

7. The method of assembling conductive terminals of a plurality of electrical connectors as claimed in claim 1, wherein the electrical connectors are independent electrical connectors which are overlapping up and down during assembly of the conductive terminals.

8. The method of assembling conductive terminals of a plurality of electrical connectors as claimed in claim 1, wherein each guiding hole partially alternately overlaps at least one of the first fixing holes.

9. The method of assembling conductive terminals of a plurality of electrical connectors as claimed in claim 1, wherein each guiding hole surrounds one of the fixing holes.

10. The method of assembling conductive terminals of a plurality of electrical connectors as claimed in claim 1, wherein each guiding hole has at least one guiding surface connected with the fixing hole.

11. The method of assembling conductive terminals of a plurality of electrical connectors as claimed in claim 1, wherein the terminal carrier structure has one or two conductive terminals of one of the conductive terminal groups formed between two adjacent conductive terminals of the other conductive terminal group.

12. The method of assembling conductive terminals of a plurality of electrical connectors as claimed in claim 1, wherein one conductive terminal of one of the conductive terminal groups is adjacent to one conductive terminal of the other conductive terminal group on the terminal carrier structure.

13. The method of assembling conductive terminals of a plurality of electrical connectors as claimed in claim 1, wherein two conductive terminals of one of the conductive terminal groups are respectively located on two outer sides of the terminal carrier structure.

* * * * *